United States Patent [19]

Leonard

[11] Patent Number: 4,623,003

[45] Date of Patent: Nov. 18, 1986

[54] HYDRAULICALLY ACTUATED SPOOL VALVE

[76] Inventor: Willie B. Leonard, 5902 Royalton, Houston, Tex. 77036

[21] Appl. No.: 721,110

[22] Filed: Apr. 8, 1985

[51] Int. Cl.[4] ..... F15B 13/043

[52] U.S. Cl. ..... 137/625.66; 137/625.62; 137/625.63; 137/625.64

[58] Field of Search ..... 137/625.62, 625.63, 137/625.64, 625.66

[56] References Cited

U.S. PATENT DOCUMENTS

| | | | |
|---|---|---|---|
| 2,931,389 | 4/1960 | Moog et al. | 137/625.62 |
| 2,964,059 | 12/1960 | Geyer | 137/625.62 |
| 3,464,318 | 9/1969 | Thayer et al. | 137/625.62 |
| 3,473,548 | 10/1969 | Ericson et al. | 137/628.62 X |
| 3,690,345 | 9/1972 | Ericson et al. | 137/625.62 |
| 3,983,908 | 10/1976 | Bartholomaeus | 137/625.62 |
| 4,094,229 | 6/1978 | Leonard . | |

FOREIGN PATENT DOCUMENTS

| | | | |
|---|---|---|---|
| 2445053 | 4/1976 | Fed. Rep. of Germany | 137/625.64 |

OTHER PUBLICATIONS

Moog Servovalve, 2 sheets.

*Primary Examiner*—Gerald A. Michalsky
*Attorney, Agent, or Firm*—Murray Robinson; David A. Rose; William E. Shull

[57] ABSTRACT

A reduced drive area hydraulically actuated spool valve is protected against cavitation and provided with enhanced lubrication by connecting the variable volume inside the valve housing adjacent the non drive area of the spool end to the source of pressure fluid controlled by the valve. A stub piston is affixed to the spool end in fluid tight relationship, e.g. integral, to exclude the pressure fluid from the area therebetween. A floating cylinder is provided for the stub piston to eliminate the need for precise alignment of the stub piston axis with respect to the housing. Fluid passages substantially balance the fluid force acting on this floating cylinder to keep it from binding, this being just enough unbalance to hold the cylinder end against a ball pivot.

13 Claims, 5 Drawing Figures

HYDRAULICALLY ACTUATED SPOOL VALVE

CROSS REFERENCE TO RELATED APPLICATION

This application relates to an improvement upon the apparatus described in copending application Ser. No. 676,702 filed 11-30-84 by the present inventor entitled "Spool Valve" the disclosure of which is incorporated herein by reference.

BACKGROUND OF THE INVENTION

Hydraulically actuated spool valves employing a reduced drive area at the spool end are known. One such arrangement is disclosed in the aforementioned copending patent application and the prior art referred to therein. In such constriction a separate piston and cylinder means is employed as the motor to reciprocate the spool rather than employing the spool end and its bearing as the piston and cylinder. This enables the piston diameter to be smaller than the spool end diameter so that a greater stroke is achieved for a given volume of hydraulic fluid supplied to the drive motor. The separate piston is kept in contact with the spool end by a spring. Separation of the motor piston and the spool makes it unnecessary for these parts to be coaxial, thus saving on machining costs. The volume between the spool end and drive piston is enclosed so that it can be supplied with lubricant, e.g. system hydraulic fluid. Since the volume varies, to prevent hydraulic lock and cavitation, the volume is vented to reservoir, and/or in the case of the usual valve in which both ends of the spool are driven, to the volume at the opposite end of the spool.

Although the known construction operates satisfactorily, there is still a certain amount of wear adjacent the spool end, and its bearing and the piston which it would be desirable to reduce. In addition, especially in applications such as for hydraulic drive of an earth shaker for seismic exploration, e.g. "Vibrosis", it is desirable to reduce the mass of the moving parts, liquid and solid, in order that the valve motion can more precisely follow the dictates of the electric control signal applied to its pilot valve.

SUMMARY OF THE INVENTION

According to the invention, high pressure fluid from the hydraulic fluid system controlled by the valve is fed to the variable volume inside the valve housing adjacent the non-drive area of the spool end, thereby supplying high pressure lubricant to the spool end and insuring adequate lubrication, due to the pressure difference across the spool end. More importantly, the variable volume is kept at constant pressure, fluid being admitted and expelled rapidly as the volume changes, thereby preventing hydraulic lock, cavitation, or sudden acceleration due to pressure drop at the spool end.

Further in accordance with the invention, the reduced area drive for the spool is achieved by providing the spool end with a stub piston of smaller diameter than the spool and made integral with the spool end (or sealingly affixed thereto) eliminating the mass and complexity and added size of a contact maintaining spring. The need for precise allignment of the piston axis and spool axis is eliminated by providing a floating cylinder around the piston, bearing at its closed end against a ball pivot in the housing. To prevent hydraulic locking of the cylinder against its pivot, axial forces on the cylinder due to the high pressure fluid in the variable volume and at the drive areas of the spool motor are substantially equalized by fluid passages, leaving just enough unbalanced force to keep the cylinder seated on the ball pivot.

BRIEF DESCRIPTION OF THE DRAWINGS

For a detailed description of a preferred embodiment of the invention, reference will now be made to the accompanying drawings wherein.

The valve is preferably made of metal, e.g. steel, except for the seals which preferably are made of an elastomer such as an oil resistant rubber.

The LVDT at one end of the valve also incorporates the usual electrical materials such as copper conductors, plastic insulation, and magnetic core.

DETAILED DESCRIPTION OF PREFERRED EMBODIMENT

Figure 1:
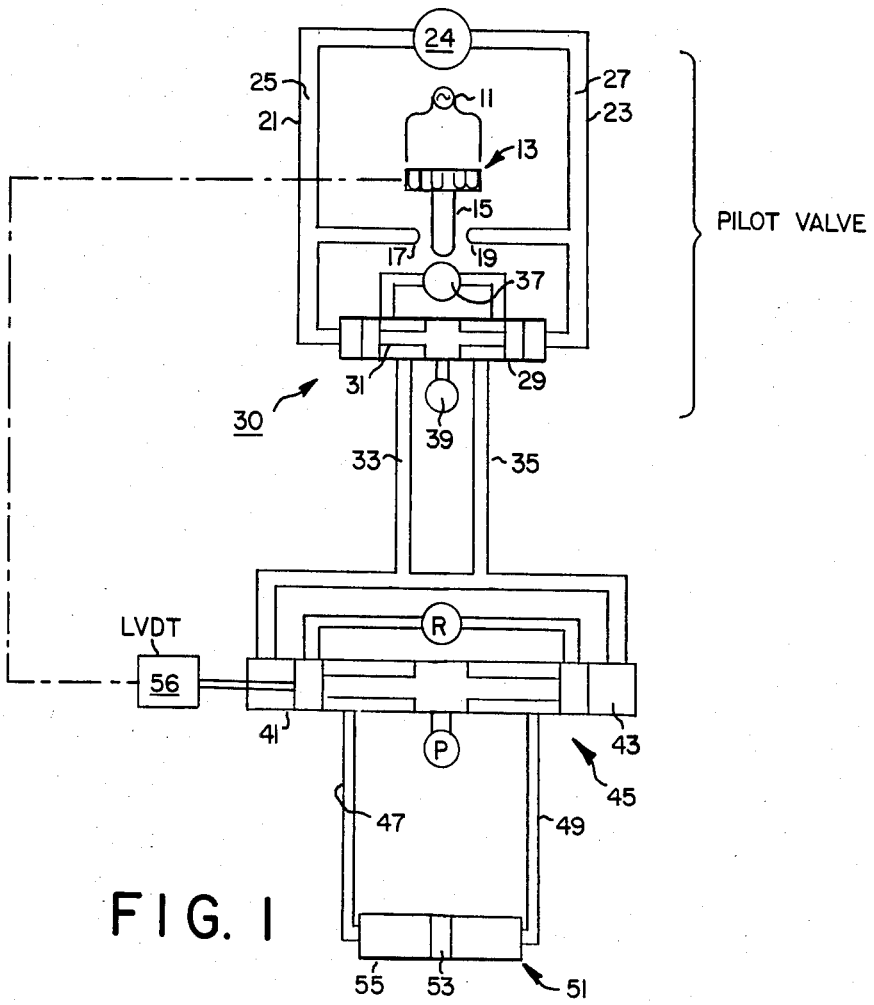
FIG. 1 is a schematic drawing illustrating a seismic shaker system, a valve according to the invention forming a part thereof.

Referring now to FIG. 1, there is shown a seismic shaker system comprising a source 11 of alternating current of desired frequency and wave shape, suitable, e.g. for the "Vibrosis" system of seismic exploration.

Source 11 is connected to electromechanical transducer 13 which actuates flapper 15. The flapper moves back and forth relative to nozzles 17, 19 from which is variably vented fluid from lines 21, 23 from a hydraulic pump or other source of pressure fluid 24, downstream from flow restrictors 25, 27. According to the degree of venting, pressure will vary in lines 21, 23 where they respectively connect to the ends of the housing 29 of a four way spool valve 30. According to the differential pressure applied to the ends of the spool valve housing, the spool 31 therein is reciprocated axially. Axial shifting of spool 31 alternately connects flow lines 33, 35 to source 37 (pump) of hydraulic pressure or to reservoir 39 at lower pressure. The flapper controlled spool valve 30 may be called the pilot valve, employing first stage (flapper valve) and second stage (four way valve) hydraulic amplifiers.

The pilot valve, via lines 33, 35, alternately pressurizes and relieves the hydraulic motors (piston and cylinder means) 41, 43 at the ends of the third or main stage hydraulic amplifier four way valve 45, to be described in more detail with reference to FIGS. 2–4. Movement of valve 45 is sensed by LVDT 56 which feeds an electric signal back to transducer 13 to stablize the operation of the system.

Flow lines 47, 49 controlled by valve 45, alternately are connected to source P (pump) of hydraulic fluid under pressure and to reservoir R of lower pressure hydraulic fluid. Lines 47, 49 are connected to opposite ends of shaker 51, oscillating its free piston 53 within cylinder 55. For further details see the present inventor's prior U.S. Pat. No. 4,094,229, esp. FIGS. 1, 10, and 42.

It may be noted that at each stage of amplication, a smaller amount of power and motion controls a larger amount of power and/or motion.

Figure 2:
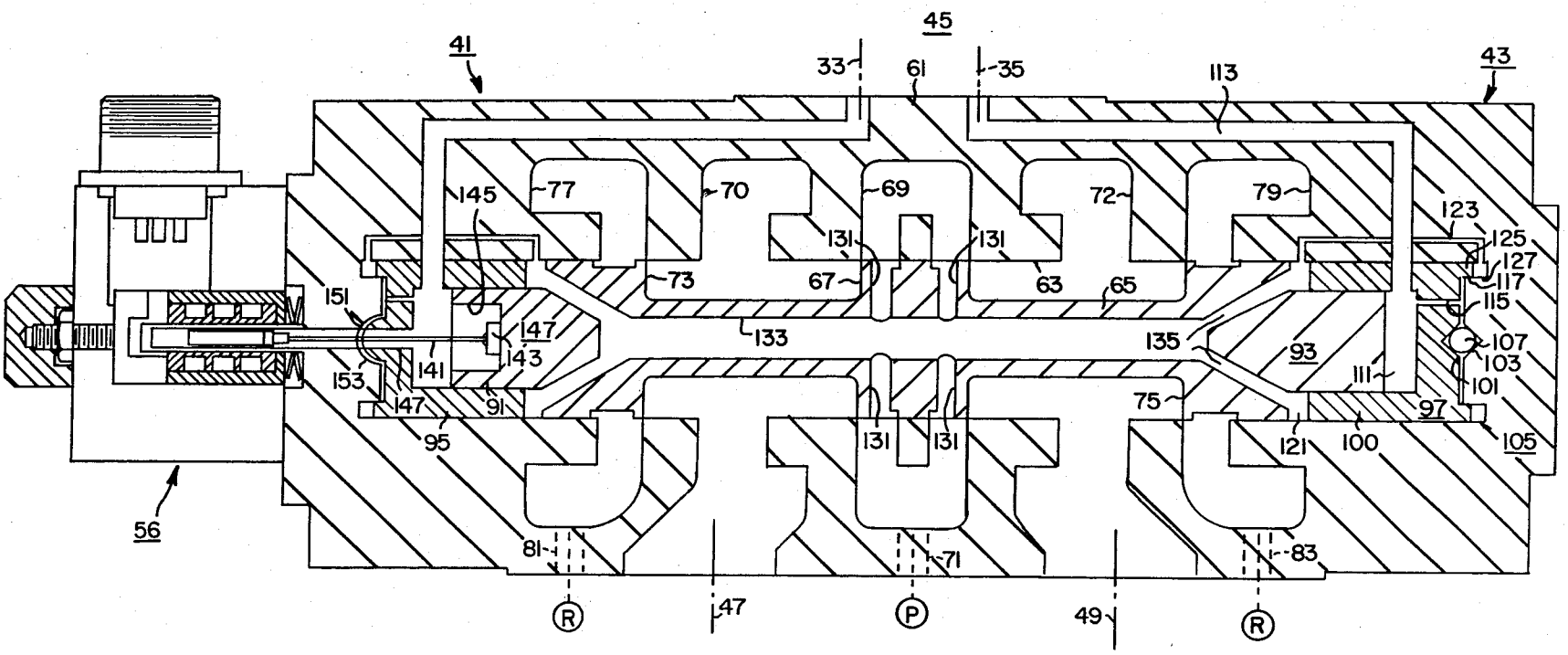
FIG. 2 is a semi-schematic axial section through a valve incorporating the invention.

Referring now to FIG. 2, main stage valve 45 comprises a housing 61 having an axial bore 63 within its axially slidably mounted spool 65. Spool 65 has a central closure 67 to block flow from inlet annulus 69 connected via inlet port 71 to a source P of hydraulic fluid under pressure. When the spool moves axially, closure 67 uncovers annulus 69 at one side or the other and allows flow to one or the other of annular inlet cavities 70, 72 and thence to one or the other of flow lines 47, 49.

Spool 65 has end closures 73, 75 which block flow from annuluses 77, 79 connected via ports 81, 83 to reservoir R of fluid at a pressure lower than P. When the spool moves axially closures 73, 75 move to uncover one or the other of annuluses 77, 79 and allow flow from one or the other of flow lines 47, 49.

Each closure 73, 75 has a generally cylindrical outer periphery and is provided with an axially outwardly extending stub piston as at 91, 93, received respectively in floating cylinders 95, 97. Except for one detail, relating to the adjacency of LVDT 56, the construction at each end of valve 45 is the same, so that the further description will detail only one end of the valve, it being understood that the construction at the other end is the same.

Cylinder 97 is slidably received in cylindrical socket 100 in housing 61 and is provided at its outer, closed end with a central conical depression 101 opposite a like coaxial depression 103 in end 105 of housing 61. Between the depressions is a steel ball 107 on which the cylinder can rock and rotate relative to socket 100, and to a degree, move laterally relative to socket 100 as the ball rolls up the sides of the depressions. Such movements enable cylinder 97 to move so that its axis is coaxial with stub piston 93 even though socket 100 may not be coaxial with piston 93.

Chamber 111 at the end of piston 93, inside cylinder 97, is connected by flow passage 113 with flow line 35, whereby to move spool 65 axially in response to control fluid from the pilot valve (FIG. 1). To prevent the pressure of the control fluid from moving cylinder 97, and holding it fast against ball 107, which might cause the cylinder to bind against stub piston 93, a passage 115 through the closed end of cylinder 97 equalizes pressure on opposite sides of the closed end of the cylinder. Since the interior area of the closed end is smaller than the exterior area (within seal area 117) there is a net force from the control fluid pressure tending to move the cylinder off its pivot, such net force varying as the control fluid pressure varies between pump and reservoir pressure. Cylinder 97 is also subject to axial force caused by admission of pump pressure adjacent to its inner annular end in variable volume chamber 121, as will be explained in the following. This axial force is counterbalanced by the provision of fluid passage 123 which connects chamber 121 with the other end of cylinder 97 outside of seal area 117. Since seal area 117 is of larger diameter than the inner diameter of cylinder 97, the net force due to the pressure on chamber 121 on cylinder 97 will urge it towards pivot 107. The diameter of seal area 117, formed between annulus lip 125 and cylindrical boss 127 on the housing is chosen so that this force will be larger than that due to the pressure of the control fluid, so the cylinder will remain in contact with ball 103.

Central closure 67 of the spool is provided with a plurality of radial passages 131 communicating high pressure annulus 69 with passage 133 that extends axially of spool 65. Passage 133, at each end connects to a plurality of axi-radial passages 135 which open into variable volume chamber 121 adjacent the nondrive area at the end of the spool. This volume is therefore constantly full of high pressure hydraulic fluid, preventing cavitation, but such fluid is free to leave the volume if the volume contracts.

There is therefore a pressure differential across the outer periphery of closure 75 of the spool, due to the difference in pressure between the pump pressure fluid in volume 121 and reservoir pressure fluid in annulus 79. For example pump pressure may be 3000 psi and reservoir pressure may be 100 psi. This pressure differential will cause hydraulic fluid to move between the outer periphery of closure 75 and bore 63 in the valve housing and lubricate the area.

Turning to the other end of the valve, actuator rod 141 from LVDT 56 is secured to closure 73 by a screw 143 within socket 145 in the end of stub piston 147. Piston 147 is otherwise the same as piston 93 at the other end.

Actuator rod 141 extends through hole 147 in the otherwise closed end of cylinder 95. In lieu of a ball pivot like 107 supporting cylinder 97, cylinder 95 is provided with a spherical boss 151 received in a spherical recess 153 in the valve housing. Rod 141 extends through boss 151 and recess 153. In other respects cylinder 95 is like cylinder 97, both being floating cylinders lightly urged against their pivots by hydraulic pressure.

It would be possible to use a pivot construction like that at the left end of the valve on the right end also. In lieu of a spherical pivot, the floating cylinders could be supported at their outer peripheries by an elastomeric ring (O-ring).

Figure 3:
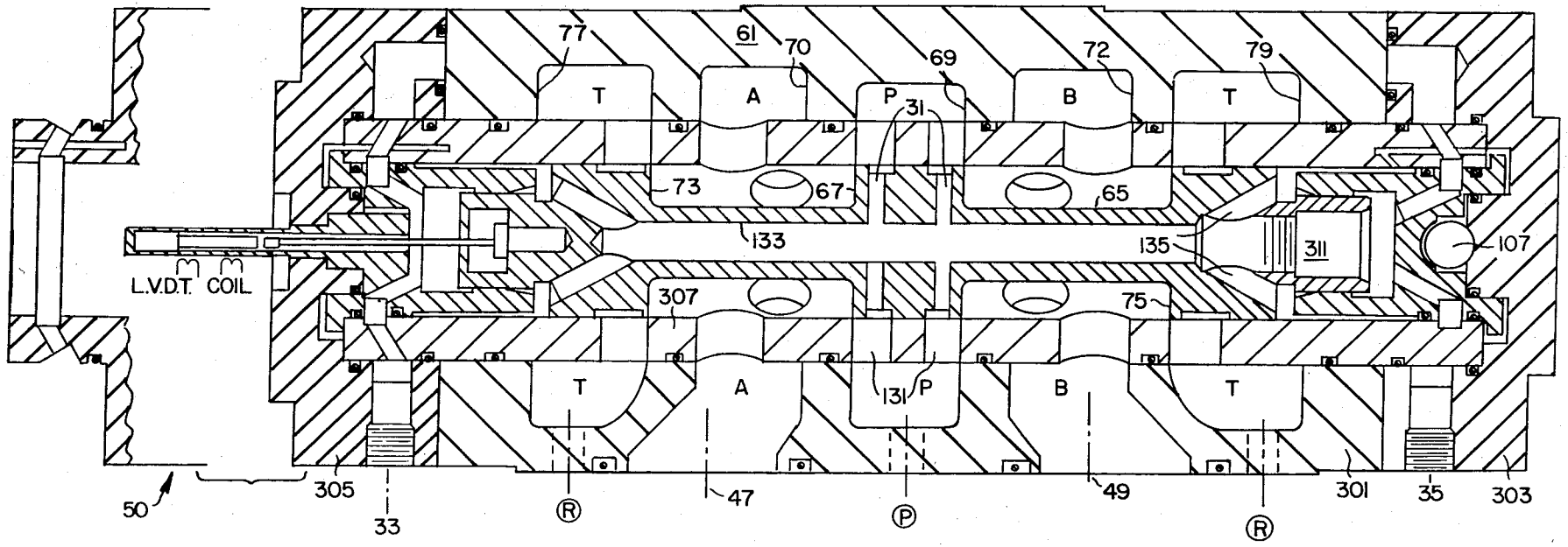
FIG. 3 is an axial section to scale of the valve shown schematically in FIG. 2.

From the foregoing description the actual valve construction shown in FIGS. 3 is believed to be readily apparent so that a greal deal of further detailed description is unnecessary. Like reference numbers have been applied to FIGS. 2 and 3. Some added description of the FIG. 3 construction may be helpful however.

In the FIG. 3 construction, the housing includes a main body 301 and two end caps 303, 305 secured thereto by screws (not shown); and a liner sleeve 307 captured between the end caps. To facilitate machining of the axial passage in the spool, the passage is bored clear through at one end and the latter is then closed by screw plug 311. The liner and end caps are sealed to the body by a plurality of static seal O-rings. The seal areas at the ends of the cylinders separating the outer and inner volumes adjacent thereto are also sealed by O-rings, which in this case are sliding seals.

Figure 4:
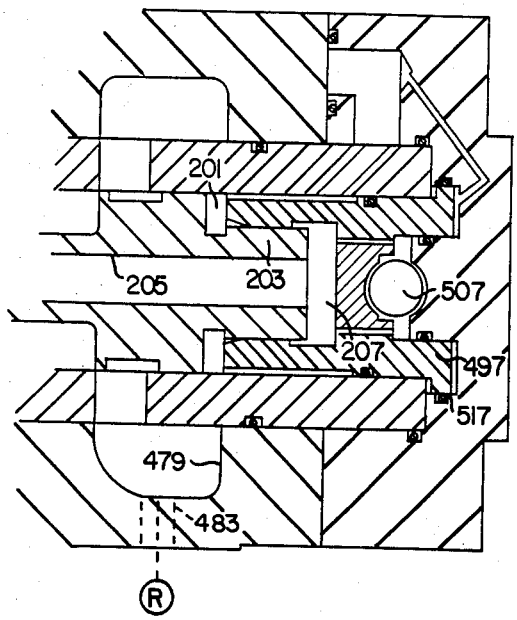
FIG. 4 is a fragmentary view similar to FIG. 2 showing a modification.

Referring now to FIG. 4, there is shown a modified valve which is the same as that of FIG. 2 except that the drive area at the end of the spool to which control fluid line 113 connects is the annular area 201 around the stub piston 203 and the high pressure fluid from the axial flow passage 205 is connected to the variable volume chamber 207 at the end of the stub piston. Parts which are the same as or analogous to the FIG. 2, 3 construction are given the same number plus 400.

Figure 5:
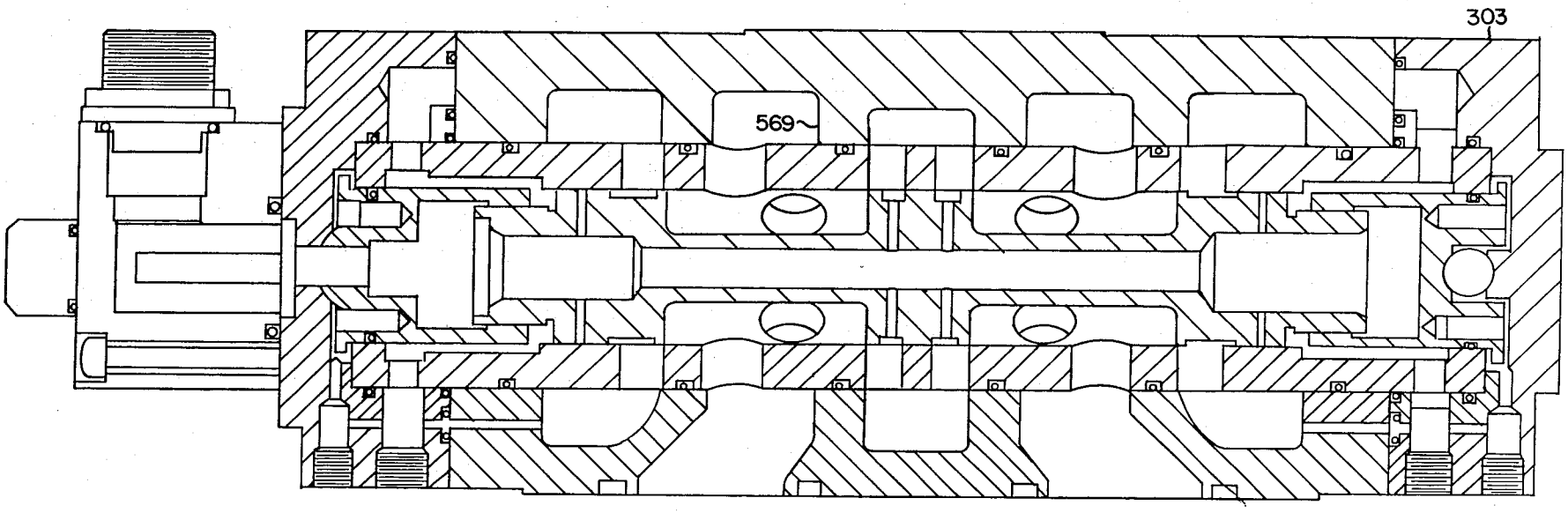
FIG. 5 is an axial section to scale of the valve shown schematically in FIG. 4.

FIG. 5 shows the FIG. 4 construction to scale and in greater detail, except that the pressure equalization passages have been omitted.

While preferred emodiments of the invention have been shown and described, modifications thereof can be made by one skilled in the art without departing from the spirit of the invention.

I claim:

1. A fluid actuated spool valve comprising:

a housing having a bore, a spool axially slidable in said bore, said housing having inlet means adapted for connection to a source of pressure fluid and outlet means adapted for connection to a load cylinder, said spool having closure means controlling flow through said inlet and outlet means according to the axial position of the spool, said closure means in one position of said spool blocking flow from said inlet means to said outlet means and in another position allowing flow from said spool to said outlet means, said inlet means including port means in said housing communicating with said bore, said spool having closure means thereon contacting said bore and in said one position of said spool blocking entrance of fluid into said bore, stub piston means on the spool extending axially therefrom defining an annular area at the end of the spool around the piston and a disc area at the end of the piston, means associated with said housing providing a cylinder having a side wall around the piston and an end wall opposite said disc area and having at the end remote from said end wall an annular lip opposite said annular area, said side wall and end wall and disc area defining a first chamber, said housing, annular lip, and annular area defining a second chamber, means to admit control fluid to one of said chambers to move said spool axially, and means to admit fluid from said inlet means to the other chamber to keep same filled with fluid at constant pressure and lubricate said closure means, and wall means always separating said chambers whereby they can be at different fluid pressures.

2. Valve according to claim 1 wherein, said means to admit control fluid to one of said chambers admits fluid to said first chamber, and said means to admit fluid from said inlet means to the other chamber admits fluid to said second chamber.

3. Valve awarding to claim 1 wherein, said means to admit control fluid to one of said chambers admits fluid to said second chamber, and said means to admit fluid from said inlet means to the other chamber admits fluid to said first chamber.

4. Valve according to claim 1, said cylinder being floatingly mounted within said housing for relative movement relative thereto, allowing the cylinder to be coaxial with said stub piston.

5. Valve according to claim 4, the surface of said end wall nearest said disc area constituting an inner surface thereof and the surface of said end wall facing away from said inner surface constituting the exterior of said end wall and the portion of said housing adjacent said exterior of the end wall being an interior surface of said housing, said valve including pressure equalization fluid passage means connecting said chambers with the volume defined between said exterior of said end wall and said interior surface of said housing; said volume constituting an end volume.

6. Valve according to claim 5, said end volume being divided into outer and inner parts by seal means, said pressure equalization means comprising first equalizer passage means connecting said first chamber with said inner part and second equalizer passage means connecting said second chamber with said outer part.

7. Valve according to claim 6, the area of said lip and the area inside said lip being proportioned relative to the areas of the exterior of said end wall within said first and second parts to create a net axial force urging said cylinder end wall away from said stub piston.

8. Valve according to claim 7, including pivot means pivotally supporting the exterior of said end wall relative to said housing.

9. Valve according to claim 8, said pivot means comprising a ball captured between depressions in said exterior of the end wall and the adjacent interior of said housing.

10. Valve according to claim 8, said pivot means comprising a spherical boss on said exterior of said end wall and a socket in the adjacent interior of said housing receiving said boss.

11. Valve according to claim 10, there being an axial passage through said end wall, boss, and socket for the passage of an actuator rod for an LVDT connected by said rod to said stub piston.

12. Valve according to claim 6, said seal means lying between cylindric areas of said end wall and a cylindrical boss on the interior of said housing.

13. Valve according to claim 1, said valve being a four way valve symmetrical about a mid plane transverse to the axis of said spool, said means conducting fluid from said inlet means extending axially of the spool to closure means at each end of the spool.

* * * * *

UNITED STATES PATENT AND TRADEMARK OFFICE

CERTIFICATE OF CORRECTION

PATENT NO. : 4,623,003

DATED : NOVEMBER 18, 1986

INVENTOR(S) : WILLIE B. LEONARD

It is certified that error appears in the above—identified patent and that said Letters Patent is hereby corrected as shown below:

Column 1, line 17, change "constriction" to — construction —.

Column 3, line 11, after "annular" delete "inlet".

Signed and Sealed this

Seventeenth Day of March, 1987

*Attest:*

DONALD J. QUIGG

*Attesting Officer*

*Commissioner of Patents and Trademarks*